US005536390A

United States Patent [19]

Herrmann

[11] Patent Number: 5,536,390

[45] Date of Patent: Jul. 16, 1996

[54] THERMAL DECOKING OF CRACKING OVENS AND COOLERS

[75] Inventor: Hellmut Herrmann, Kassel, Germany

[73] Assignee: Schmidt'sche Heissdampf GmbH, Kassel-Bettenhausen, Germany

[21] Appl. No.: 326,073

[22] Filed: Oct. 19, 1994

[30] Foreign Application Priority Data

Oct. 20, 1993 [DE] Germany ..... 43 35 711.3

[51] Int. Cl.[6] ..... C10G 9/12

[52] U.S. Cl. ..... 208/48 R; 585/648

[58] Field of Search ..... 208/48 R, 48 G; 585/648, 650

[56] References Cited

U.S. PATENT DOCUMENTS 4,376,694 3/1983 Lohr et al. ..... 208/48 R 4,420,343 12/1983 Sliwka ..... 134/22.15

4,589,473 5/1986 Kehrer ..... 165/1

FOREIGN PATENT DOCUMENTS 3010000 3/1980 Germany .

*Primary Examiner*—Asok Pal

*Assistant Examiner*—Bekir L. Yildirim

*Attorney, Agent, or Firm*—Chilton, Alix & Van Kirk

[57] ABSTRACT

Thermal decoking of cracking gas coolers which operate with low gas pressure is accomplished by controlling the temperature of a cleaning gas delivered to the cooler. The temperature control is achieved by mixing a cleaning gas, which has been heated in a cracking oven, with a stream of relatively cool cleaning gas upstream of the cooler.

20 Claims, 1 Drawing Sheet

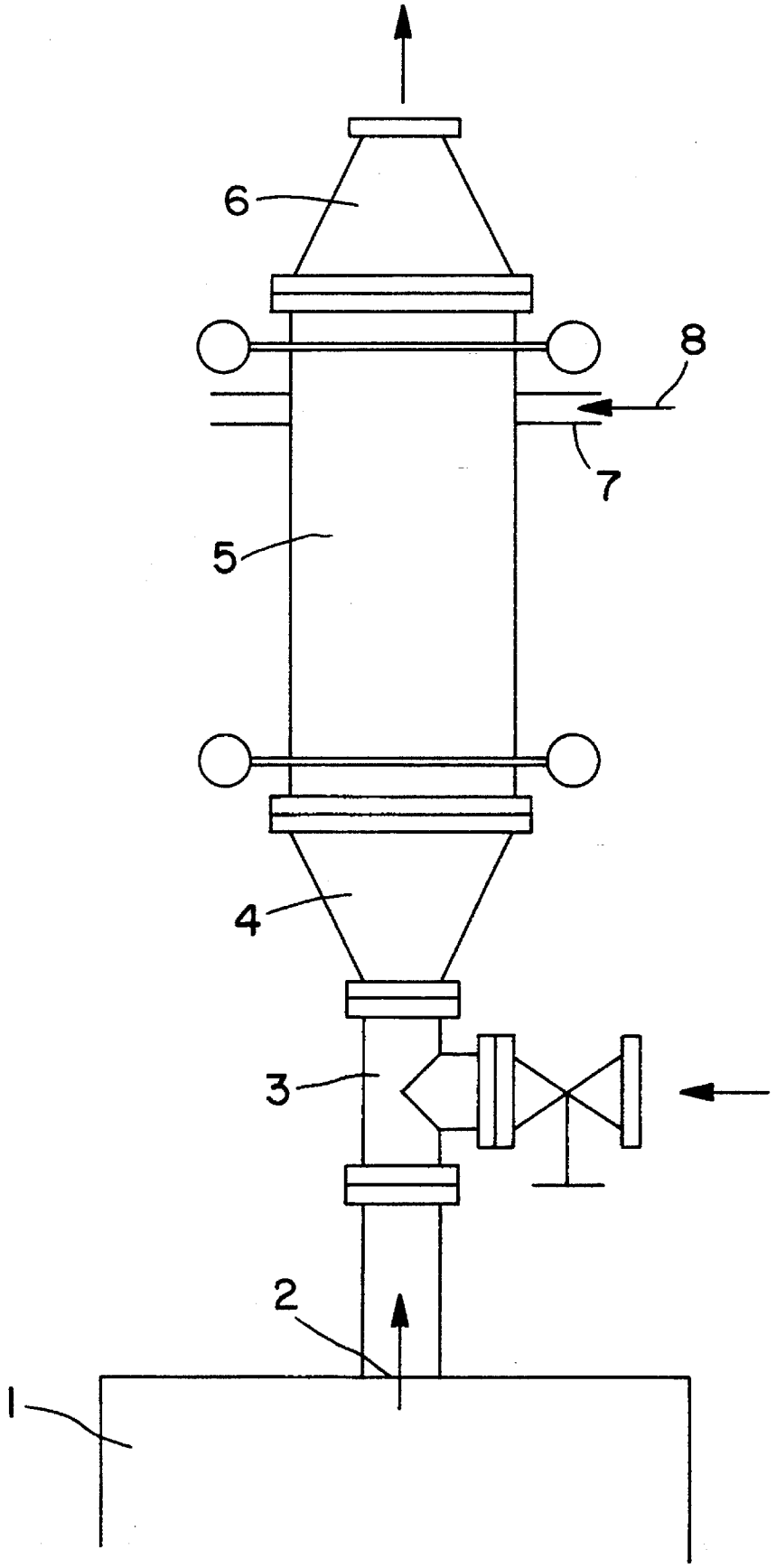
6
8
7
5
4
3
2
1

THERMAL DECOKING OF CRACKING OVENS AND COOLERS

BACKGROUND OF THE INVENTION

1. Field of the Invention

This invention relates to the decoking of cracking ovens and/or cracking gas coolers. The invention, more particularly, is directed to a process for the thermal decoking of gas coolers which are connected in series with cracking gas ovens.

2. Description of the Prior Art

Cracking ovens and associated gas coolers collect coke deposits on their interior surfaces during the process of cracking petroleum products. As may be seen from published German Patent No. 30 100 000, for example, it is known to use a mixture of steam and air (or oxygen), a steam/hydrogen mixture, or an air and oxygen mixture to clean coke from cracking ovens and associated gas coolers. These cleaning gases are heated to a temperature of at least 700° C. in the cracking oven, and then fed through a cracking gas cooler. The cleaning gas mixtures react with the petroleum coke deposited in the cracking gas cooler and the cracking oven to gasify and burn the coke so as to remove it from the ovens and coolers. Efficient decoking demands that the coolant flowing through the cracking gas cooler, be at pressure of at least 120 bar during the cleaning cycle described in DE 30 100 000. This pressure level is required so that the cracking gas cooler tubing, and hence the petroleum coke deposits, reach a high enough surface temperature during the transit time of the cleaning gas to cause a reaction between the petroleum coke and the cleaning gas.

Thermal decoking has not proven to be a practical technique for decoking gas cooler systems designed for operation at a coolant pressure of less than 120 bar. To amplify the preceding remark, a process which would result in sufficiently high gas cooler surface temperatures, and hence adequate reaction time in the absence of high pressure, would require operating the cracking gas cooler during cleaning without coolant in the liquid or secondary side of the gas cooler. However, gas coolers are not designed for operating under these conditions and, accordingly, there would be a danger that the tubing of the cracking gas cooler could be damaged. Restated, the cooler tubing will typically not be constructed for dry operation at the high gas temperatures that exist when heated cleaning gas, exiting the outlet of the cracking oven, is delivered directly into the downstream gas cooler. The temperature of gases leaving a cracking oven can be as high as 850° C. Without a cooling medium in the cracking cooler, such a high temperature cleaning gas could damage the cooling apparatus since it is not designed for such high temperature operation.

SUMMARY OF THE INVENTION

The invention is a novel process for the thermal decoking of a gas cooler which is connected in series with the outlet of a cracking oven. In the preferred embodiment, a cleaning gas, which may be a mixture of air and steam, is introduced into a cracking oven. This first stream of cleaning gas exits the cracking oven at an elevated temperature. The first stream of cleaning gas is admixed with a second, lower temperature, stream of cleaning gas. The second stream preferably has a temperature in the range of 20°–200° C. The mixing of the two streams of cleaning gas produces a cleaning gas mixture having the appropriate temperature for delivery to a gas cooler. The mixing, and thus the temperature adjustment of the cleaning gas streams, takes place in a connector located between the cracking gas oven discharge port and the cracking gas cooler inlet. The cooling gas comprising the second stream is compatible with the first stream and thus may also be composed of air and steam.

The combined gases, i.e., the temperature adjusted cleaning gas mixture, is caused to flow into the cracking gas cooler. The cleaning gas mixture delivered to the cooler will initially have a temperature in the range of 250°–300° C. Once the cleaning gas is flowing through the cracking gas cooler, the flow of coolant to the cooler is interrupted, and the secondary side of the cooler may subsequently be depressurized and drained. The temperature of the cleaning gas being delivered to the cracking gas cooler is then raised to a level in the 300°–600° C. range, preferably in the range of between 400°–450° C. The temperature of the cleaning gas entering the cooler continues to be controlled by admixing heated cleaning gas with "cool" cleaning gas. The pressure of the gas is set to between 1 and 10 bar. When the cleaning gas, preferably at a temperature of 400°–450° C., contacts surfaces coated with coke deposits, a sufficiently high surface temperature is reached to set in motion the reaction between the cleaning gas and the coke layer which will cause the coke layer to burn off. By precisely regulating the temperature of the cleaning gas mixture at the cooler inlet, preferably by varying the ratio of the cleaning gas discharged from the cracking oven to the second cleaning gas stream, a high enough temperature for the cleaning cycle is maintained. At the same time, the cleaning gas temperature is limited so that the cracking gas cooler is not exposed to temperatures that will damage the heat exchanger tubing.

The thermal decoking process of the invention has the advantage of enabling the cleaning of both the oven and cooler simultaneously. This allows a substantial saving of time and, therefore, increased efficiency.

It is therefor an object of the invention to provide a thermal decoking process that efficiently operates at a pressure less than 120 bar.

It is another object of the invention to provide a thermal decoking process that does not require separate cleaning of a cracking oven and an associated cracking gas cooler.

It is yet another object of the invention to provide a thermal decoking process that will not damage a cracking gas cooler that was not constructed for high temperature dry operation.

BRIEF DESCRIPTION OF THE DRAWING

The drawing is a schematic view of a cracking system including a cracking gas cooler at the outlet side of cracking oven, the system having been modified for practice of the present invention.

DETAILED DESCRIPTION OF THE DISCLOSED EMBODIMENT

A cracking oven or reactor 1 is fluidly connected at an outlet port 2 to a connecting pipe 3 which is in the form of a tee connector. The connecting pipe 3 forms a fluid passage for gases exiting oven 1 to a cooling gas introduction pipe 4 of a cracking gas cooler 5, cooler 5 thus being connected in series with oven 1. Cooler 5 is a heat exchanger having a primary side, through which the gas discharged from oven 1 passes, and a secondary side, through which a coolant is circulated along a coolant flow path 7 in the direction of arrow 8. During normal use of the disclosed apparatus, a hydrocarbon stream necessary to produce a cracking gas flows from oven 1 through pipes 3 and 4 to cooler 5. The temperature of the stream of cracking gas is normally around 850° C. When decoking is necessary, the hydrocarbon stream is interrupted and replaced by a cleaning gas which, typically, comprises a mixture consisting of steam and air in any mixing ratio desired. The cleaning gas may, in some cases, consist of only steam or air.

In accordance with the present invention, the performance of oven 1 is reduced so as to cause the cleaning gas to initially be heated to a temperature of approximately 300° C. in the cracking oven. This heated primary stream of cleaning gas flows through outlet port 2 to connecting pipe 3 and thence into cooling gas introduction pipe 4. A second stream of cleaning gas, which functions as a cooling gas, is introduced into the stream flowing through connector 3 via a control valve. Connector 3 thus functions as a mixer for the two streams of cleaning gas. The temperature of the second stream of cooling gas is controlled to be within the range of 20°–200° C. The quantity of the second stream of cleaning gas is adjusted by means of the control valve. The second stream of cleaning gas consists of air, steam, or a mixture of air and steam. The heated primary cleaning gas and the second stream of cooling gas are mixed in a ratio which will result in a combined cleaning gas stream which initially has a temperature of approximately 250° C. This temperature controlled cleaning gas mixture flows through cracking gas cooler inlet 4 into the cracking gas cooler 5. Once the cleaning gas is flowing through the cracking gas cooler and being discharged from the cracking gas cooler outlet 6, i.e., once the heat exchanger internal temperature has been reduced to the appropriate level, the flow of water or other coolant to the cracking gas cooler via cooling flow path 7 is interrupted and the coolant may be drained from the cooler.

After the coolant is drained from cooler 5, the temperature of the cleaning gas stream exiting oven 1 is raised, by exercising control over the combustion process in the oven, to around 850° C. This will result in the temperature of the cleaning gas mixture being delivered to cooler 5 being raised to a second level which is within the range of 300° C. to 600° C., and preferably 400°–450° C. This temperature level will thereafter be maintained by controlling the flow of the second stream of cleaning gas.

The temperature of the cleaning gas to the cracking gas cooler 5 is precisely regulated to maintain a second temperature level which is sufficiently high for the cleaning cycle while at the same maintaining the cleaning gas, and thus the cooler, at a sufficiently low temperature to prevent damage to the heat exchanger apparatus in the absence of coolant flow. The maximum cleaning gas temperature is related to the material from which the cooler is constructed, the type of construction employed in the cooler and the temperature differential which the gas cooler can withstand. Attention must also be paid to obtaining a protective layer of iron magnetite on the coolant, i.e., the secondary, side of the cooler. Once the temperature of the secondary stream of cooling gas is selected, the temperature of the cleaning gas entering the cracking gas cooler will preferably be controlled by changing the mass ratio of primary heated cleaning gas to secondary cooling cleaning gas. The temperature of the gas delivered to the cooler may, of course, also be adjusted by regulation of the temperature of the primary and/or secondary streams of cleaning gas.

In the preferred mode of practice of the invention, the temperature of the cleaning gas at the cracking gas cooler outlet 6 is monitored to avoid the release of too much energy in cooler 5 from the burning of the coke deposits. The difference in temperature between the cleaning gas at the inlet 4 and outlet 6 of cooler 5 should, in most cases, not be greater than 30°–50° C. Should the measured temperature differential be greater than 30°–50° C., the temperature of the cleaning gas mixture at the cooler inlet 4 will be reduced.

The time necessary for complete decoking of the cracking oven and cracking gas cooler will depend upon the thickness and consistency of the petroleum coke deposit. The necessary time will be determined empirically for each cooler. As a general rule, the cleaning will take from 10 to 40 hours.

The end of the cleaning cycle can be determined by measuring the $CO_2$ level at the cracking gas cooler outlet 6. The proper $CO_2$ level for the conclusion of a cleaning cycle must be determined empirically for each individual oven-cooler combination.

After the decoking is completed, the temperature of the cleaning gas mixture at the cracking gas cooler inlet is maintained at about 250° C. The coolant flow path 7 of the secondary side of the cracking gas cooler is then refilled with coolant. Finally, the oven and the cooler are returned to production by discontinuing the cleaning gas streams, introducing of the process gas to the cracking oven, and running the oven up to normal operating temperature.

While a preferred embodiment has been shown and described, various modifications and substitutions may be made thereto without departing from the spirit and scope of the invention. Accordingly, the present invention has been described by way of illustration and not limitation.

I claim:

1. A process for the thermal decoking of a cracking gas cooler, the cracking gas cooler defining a path for the flow of process gas and a path for the flow of a coolant, the cracking gas cooler process gas flow path being connected in series with a cracking oven, the process comprising:

introducing a cleaning gas into the cracking oven;

heating the cleaning gas in the oven;

discharging the heated cleaning gas from the oven as a primary cleaning gas stream;

mixing the primary cleaning gas stream with a secondary cooling cleaning gas stream to form a cleaning gas mixture;

controlling the temperature of the cleaning gas mixture to prevent damage to the cracking gas cooler during said thermal decoking process and to cause thermal decoking during part of said thermal decoking process;

introducing the cleaning gas mixture to the cracking gas cooler process gas flow path; and discontinuing coolant flow to the cracking gas cooler coolant flow path during thermal decoking.

2. The process of claim 1, wherein said step of controlling the temperature of the cleaning gas mixture comprises:

adjusting the cleaning gas mixture temperature to a first level prior to discontinuing coolant flow; and adjusting the cleaning gas mixture temperature to a second level after coolant flow has been discontinued, the second level being higher than the first level and being sufficient to produce thermal decoking.

3. The process of claim 2, wherein said step of adjusting the cleaning gas mixture temperature to a first level includes heating the cleaning gas to approximately 300° C. in the oven, and wherein said step of adjusting the cleaning gas mixture temperature to a second level includes heating the cleaning gas to approximately 850° C. in the oven.

4. The process of claim 2, further comprising the steps of:

monitoring the $CO_2$ content of the cleaning gas mixture leaving the cracking gas cooler; and terminating the decoking process when the monitored $CO_2$ content reaches a predetermined level.

5. The process of claim 2, further comprising the steps of:

monitoring the temperature of the cleaning gas mixture leaving the cracking gas cooler during thermal decoking; and controlling the ratio of the primary cleaning gas to the secondary cleaning gas in response to the monitored temperature to maintain the monitored temperature within a preselected range.

6. The process of claim 2, wherein said step of adjusting the cleaning gas mixture temperature to a second level comprises creating a cleaning gas mixture having a temperature in the range of 300°–600° C.

7. The process of claim 2, wherein the cleaning gas and the secondary gas each comprise a member selected from the group consisting of air, steam and a mixture of air and steam.

8. The process of claim 6, wherein said step of creating a cleaning gas mixture comprises controlling the ratio of the primary cleaning gas to the secondary cleaning gas to form a cleaning gas mixture having a temperature in the range of 300°–600° C.

9. The process of claim 8, further comprising the steps of:

monitoring the temperature of the cleaning gas mixture leaving the cracking gas cooler during thermal decoking; and varying the temperature of the cleaning gas mixture by controlling the ratio of the primary cleaning gas to the secondary cleaning gas in response to the monitored temperature.

10. The process of claim 8, further comprising the steps of:

monitoring the $CO_2$ content of the cleaning gas mixture leaving the cracking gas cooler; and terminating the decoking process when the monitored $CO_2$ content reaches a predetermined level.

11. The process of claim 9, further comprising the steps of:

monitoring the $CO_2$ content of the cleaning gas mixture leaving the cracking gas cooler; and terminating the decoking process when the monitored $CO_2$ content reaches a predetermined level.

12. The process of claim 8, wherein said step adjusting the cleaning gas mixture temperature to a first level includes heating the cleaning gas to approximately 300° C. in the oven, and wherein said step of adjusting the cleaning gas temperature to a second level includes heating the cleaning gas to approximately 850° C. in the oven.

13. The process of claim 12, wherein said step of adjusting the cleaning gas mixture temperature to a second level comprises forming a cleaning gas mixture having a temperature in the range of 300°–600° C.

14. The process of claim 8, further comprising the steps of:

monitoring the temperature of the cleaning gas mixture introduced into the cooler;

monitoring the temperature of the cleaning gas mixture leaving the cooler;

determining the difference between the monitored temperatures; and adjusting the temperature of the cleaning gas mixture to maintain the determined temperature difference within a predetermined range.

15. The process of claim 8, further comprising the step of:

draining the cracking gas cooler of coolant when the temperature of the cleaning gas mixture leaving the cooler is at the first level; and wherein said step of creating a cleaning gas mixture further comprises:

raising the temperature of the cleaning gas mixture entering the cracking gas cooler to a level sufficiently high to cause decoking but below the temperature at which the cooler will be likely to be damaged after the coolant has been drained.

16. The process of claim 15, further comprising the steps of:

reducing the temperature of the cleaning gas mixture when decoking is completed; and refilling the cooler coolant flow path when the temperature of the cleaning gas mixture leaving the cooler reaches a predetermined level.

17. The process of claim 15, further comprising the steps of:

monitoring the temperature of the cleaning gas mixture leaving the cracking gas cooler during thermal decoking; and controlling the ratio of the primary cleaning gas to the secondary cleaning gas in response to the monitored temperature to maintain the monitored temperature within a preselected range.

18. The process of claim 17, further comprising the steps of:

monitoring the $CO_2$ content of the cleaning gas mixture leaving the cracking gas cooler; and terminating the decoking process when the monitored $CO_2$ content reaches a predetermined level.

19. The process of claim 18, further comprising the steps of:

reducing the temperature of the cleaning gas mixture when decoking is completed; and refilling the cooler coolant flow path when the temperature of the cleaning gas mixture leaving the cooler reaches a predetermined level.

20. The process of claim 19, wherein said step of raising the temperature of the cleaning gas mixture includes raising the temperature of the cleaning gas mixture to a level in the range of 400°–450° C.

* * * * *